US005425796A

United States Patent [19]

Loubinoux et al.

[11] Patent Number: 5,425,796

[45] Date of Patent: Jun. 20, 1995

[54] METHOD OF AND AN APPARATUS FOR FORMING A COMPOSITE THREAD INCLUDING STRETCHING OF THERMOPLASTIC FILAMENTS

[75] Inventors: Dominique Loubinoux, Chambery; Giordano Roncato, Aix Les Bains, both of France

[73] Assignee: Vetrotex France S.A., Chambery, France

[21] Appl. No.: 209,030

[22] Filed: Mar. 9, 1994

[30] Foreign Application Priority Data

Mar. 18, 1993 [FR] France ..... 93 03114

[51] Int. Cl.[6] ..... C03B 37/02

[52] U.S. Cl. ..... 65/442; 65/443; 65/450; 65/475; 65/500; 65/533; 156/175; 156/441; 264/211.12; 264/174; 428/374

[58] Field of Search ..... 65/442, 381, 479, 450, 65/486, 500, 535, 443, 475, 533; 156/175, 441; 264/211.12, 174; 428/374

[56] References Cited

U.S. PATENT DOCUMENTS

| | | | |
|---|---|---|---|
| 3,222,149 | 2/1963 | Drummond | 156/167 |
| 3,276,931 | 10/1966 | Rees | 156/441 |
| 3,705,068 | 12/1972 | Dobo | 156/441 |
| 4,818,318 | 4/1989 | McMahon | 156/175 |
| 5,011,523 | 4/1991 | Roncato et al. . | |
| 5,316,561 | 5/1994 | Roncato | 65/500 |
| 5,328,493 | 7/1994 | Roncato | 264/211.12 |

FOREIGN PATENT DOCUMENTS

| | | |
|---|---|---|
| 0505274 | 9/1992 | European Pat. Off. . |
| 0505275 | 9/1992 | European Pat. Off. . |

OTHER PUBLICATIONS

Patent Abstracts of Japan, vol. 8, No. 251 (C-252) Nov. 16, 1984 and JP-A-59 130 309 (Teijin KK) Jul. 26, 1984 (abridged).

Patent Abstracts of Japan, vol. 15, No. 206 (C-835) May 27, 1991 and JP-A-03 059 038 (Toyobo Co. Ltd.) Mar. 14, 1991 (abridged).

Patent Abstracts of Japan, vol. 16, No. 283 (C-955) Jun. 24, 1962 & JP-A-04 073 235 (Toyobo Co. Ltd.) Jun. 24, 1962 (abridged).

Patent Abstracts of Japan, vol. 16, No. 548 (C-1005) Nov. 18, 1992 & JP-A-04 209 838 (Toyobo Co. Ltd.) Jul. 31, 1992 (abridged).

Patent Abstrcts of Japan, vol. 15, No. 137 (C-821) Apr. 5, 1991 & JP-A-03 019 926 (Toyobo Co. Ltd.) Jan. 29, 1991 (abridged).

*Primary Examiner*—W. Gary Jones
*Assistant Examiner*—John Hoffmann
*Attorney, Agent, or Firm*—Pennie & Edmonds

[57] ABSTRACT

A method and apparatus for producing a composite thread formed by the association or blending of continuous glass filaments and continuous filaments thermoplastic organic matter. The thermoplastic filaments are, while in the form of a sheet, blended with a cluster or sheet of glass filaments after having been heated to a temperature in excess of their transformation temperature, stretched and then cooled in their stretched state.

12 Claims, 3 Drawing Sheets

METHOD OF AND AN APPARATUS FOR FORMING A COMPOSITE THREAD INCLUDING STRETCHING OF THERMOPLASTIC FILAMENTS

BACKGROUND OF THE INVENTION

The invention relates to a method of and an apparatus for producing a composite thread formed by the association of a multiplicity of continuous glass filaments and continuous filaments of thermoplastic organic matter. The production of such a composite thread is described in U.S. Pat. No. 5,011,523. This patent describes installations comprising a spinneret from which continuous glass filaments are drawn, and a spinning head supplied under pressure with a thermoplastic organic substance and delivering organic continuous filaments. The two types of filament may take the form of sheets or sheets and thread at the time of assembly. One advantageous construction described in the '523 patent consists in enclosing the glass thread or filaments in organic filaments when they are combined. A composite thread produced in this way has the advantage of protecting the glass filaments from friction on solid surfaces with which the composite thread comes in contact. On the other hand, this arrangement does not encourage complete homogenization in the mixing of the two types of filament. Indeed, a cross-section through the composite thread shows each type of filament occupying a preferred zone, which may be a type of assembly desirable in certain applications.

Furthermore, these composite threads display an undulating pattern. This is most obvious when the threads take the form of bobbins because the bobbins undulate over their entire periphery. This undulation of the composite thread is in fact due to a shrinkage phenomenon in respect of the organic filaments which results in an undulation of the glass filaments. This phenomenon has different disadvantages. First of all, thick sleeves are needed in order to produce coils in such a way that they can withstand the banding effect exerted by the composite thread. Furthermore, unreeling the bobbin becomes very difficult due to the changes in geometry. This presentation of the thread may however be advantageous when for example it is involved in the structure of a woven material which will subsequently be used for reinforcing a curved article. The suppleness of the material, imparted by both the aptitude of the organic filaments for deformation and the undulation of the glass filaments assists its being placed in a mold. On the other hand, for the production of composite threads intended for manufacturing unidirectionally reinforced flat articles, this form of presentation is a handicap. As the filaments are not aligned in the final composite structure, their capacity for reinforcement in one specific direction is diminished.

SUMMARY OF THE INVENTION

An object of the present invention is to provide a method and apparatus for producing a composite thread which does not display any undulation when it is formed and which remains stable in course of time.

The problem posed by the shrinkage of the thermoplastic filaments within a composite thread which contains glass filaments is resolved by the method of producing a composite thread formed by the association of continuous glass filaments emanating from a spinneret and continuous filaments of thermoplastic organic matter produced by a spinning head in which the thermoplastic filaments are, while in the form of a sheet, blended with a bundle or sheet of glass filaments after having been heated to a temperature greater than their transformation temperature, and then being drawn out and cooled very rapidly. The fact that stretching is carried out while the thermoplastic filaments are hot makes it possible to modify the structure of the filaments which are cooled in this new state. More particularly, by heating the thermoplastic filaments to a temperature greater than their transformation temperature, their structure is transformed from a crystalline state into an amorphous state. Thus, the physical characteristics of the thermoplastic filaments change. After the thermoplastic filaments treated in this way are associated with the glass filaments, the thermoplastic filaments no longer display any shrinkage. In accordance with a preferred embodiment of the invention, the thermoplastic filaments are guided in the form of a sheet until they encounter the glass filaments and are mixed with them at identical speeds over the surface of a roller.

It is likewise possible to impart a greater speed to the thermoplastic filaments. In order to carry out the blending of the two types of filaments, it is then preferable to proceed with a projection of the thermoplastic filaments in the form of a sheet into the bundle or sheet of glass filaments.

In such a case, that is to say when the thermoplastic filaments are projected at a speed greater than the drawing speed of the glass filaments, the result is a crisscrossing of the undulating thermoplastic filaments in the middle of the linear glass filaments. It is thus possible to obtain a more or less bulky composite thread which can in particular be used for manufacturing woven fabrics.

Thanks to the invention, it is possible to dispense with the use of thick sleeves which had to be able to withstand the compression due to the banding effect occasioned by shrinkage and to use ordinary sleeves which can even be removed after formation of the bobbins which then become balls or packages. This is interesting because it is then possible to use the composite threads according to the principle of unwinding or unreeling from the inside or outside.

It is likewise possible in this case to reuse these sleeves several times which represents an economy.

Another advantage of this method is to ensure greater homogeneity of the composite thread than that obtained by manufacturing methods which consist in drawing out a glass fiber or a sheet of glass filaments surrounded by thermoplastic filaments.

The invention likewise proposes an apparatus which makes it possible to carry out this method.

According to the invention, to allow the production of a composite thread formed by the association of continuous glass filaments and continuous filaments of thermoplastic organic matter, this apparatus comprises, on the one hand, an installation incorporating at least one spinneret supplied with glass. The underside of the spinneret is provided with a multiplicity of orifices. This spinneret is associated with a coating roller. The apparatus further comprises, on the other hand, another installation comprising at least one spinning head supplied under pressure with molten thermoplastic material. The underside of the spinning head is provided with a multiplicity of orifices, and is associated with a drawing apparatus of the drum type, heating and cooling means and means allowing the thermoplastic filaments to be blended with the glass filaments and finally means common to both installations allowing the assembling and winding of the composite thread onto bobbins.

Preferably, the drum drawing apparatus comprises at least three groups of drums ensuring an increasing linear speed of the thermoplastic filaments. The first group, consisting for instance of two drums, corresponds to a heating zone. The second group is composed for example of two drums driven at speeds greater than those of the preceding drums. The third group, composed for instance of two drums driven at speeds identical to those of the final drum of the second group, corresponds to a cooling zone.

The dimensions of the heating means, their number and disposition are such that the thermoplastic filaments remain in contact with them for a sufficiently long time to modify their structure. Moreover, the raising of temperature obtained must be uniform and identical for all the filaments so that their structure is identical after they have passed over the drawing apparatus.

According to a preferred embodiment of the invention, the particularly electrically operated heating means are placed at least in the first drum of the drawing apparatus which is encountered by the thermoplastic filaments. In this way, heating of the thermoplastic filaments takes place by contact with at least one heating drum. Thus it is rapid and uniform. It is likewise possible to dispose another heating means particularly of the infrared type, at least facing the first drum of the drawing apparatus.

The cooling means must likewise act very rapidly in order to fix the new structure of the thermoplastic filaments. Their size, number and disposition are chosen so that the thermoplastic filaments remain in contact for a sufficiently long time to fix their structure. The thermoplastic filaments are preferably cooled by circulation of a fluid at least in the final drum of the drawing apparatus.

The means allowing blending of the two types of filament may consist of the association of two rollers. A first "guide" roller, possibly motor driven, orientates the sheet of thermoplastic filaments towards a second roller. On this second roller, the thermoplastic filaments become blended with the glass filaments, likewise in the form of a sheet. This device has the advantage of creating an intermingling of the filaments, these latter arriving at identical speeds. The filament mixture obtained then only contains linear filaments.

In an alternative embodiment, it may be worthwhile obtaining composite threads in which the glass filaments are linear and the thermoplastic filaments display an undulating pattern. In this way, it is possible to obtain a more or less bulky thread which may in particular be used for the manufacture of woven fabrics. For this embodiment, it may be interesting to use a device which takes advantage of the properties of the fluids which may be liquids or gases such as compressed or pulsed air. For instance, it may be a venturi device which makes it possible to project thermoplastic filaments into a sheet or bundle of glass filaments, even if the thermoplastic filaments are at a speed in excess of that of the glass filaments. In order to obtain a greater speed in the thermoplastic filaments, the drum drawing apparatus must impart to the thermoplastic filaments a speed greater than the drawing speed of the glass filaments.

The means thus described make it possible to produce composite threads from glass filaments and thermoplastic filaments and which have no subsequent deformation, that is to say no longer is there any shrinkage in the thermoplastic filaments.

Such means likewise have the advantage that they can be used on one and the same level, in contrast to certain prior art installations. For this, it is possible to dispose a diverting element such as a roller between the spinning head producing the organic material and the drum-type drawing apparatus.

BRIEF DESCRIPTION OF THE DRAWINGS

Further details and advantageous characteristic features of the invention will emerge hereinafter from the description of examples of apparatus which employ the invention described with reference to the accompanying drawings, in which:

FIG. 1 shows a diagrammatic view of a complete installation according to the invention. A spinneret 1 supplied with glass either from the forehearth of a furnace which directs the molten glass straight to its top, or from a funnel containing cold glass, for example in the form of balls, which fall simply by gravity. According to one or other of these feeding means, the spinneret 1 is normally of platinum-rhodium alloy and is heated by Joule's effect in order to remelt the glass or maintain it at an elevated temperature. The molten glass then flows in the form of a multitude of streams drawn out in the form of a bundle 2 of filaments by a device not shown which likewise makes it possible to form the bobbin 3, and which will be referred to later. These filaments 2 then pass over a coating roller 4 which deposits a finishing or sizing agent on the glass filaments. This sizing may include compounds or their derivatives constituting the thermoplastic filaments 5 which will be associated with the glass filaments in order to form a composite thread 6.

Figure 1:
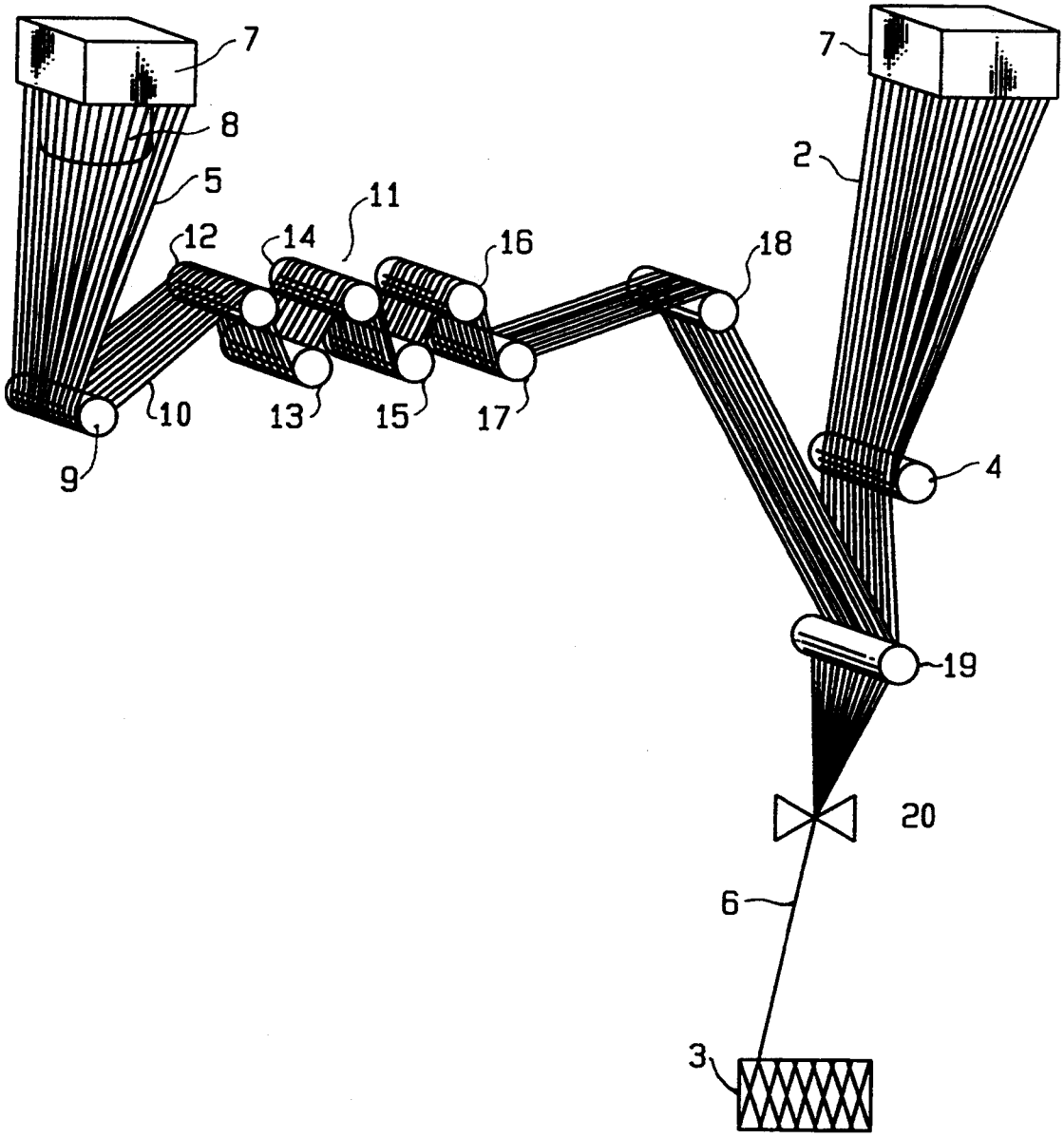
FIG. 1 is a diagrammatic representation of a first embodiment according to the invention.

This FIG. 1 likewise diagrammatically shows a spinning head 7 from which the thermoplastic filaments 5 are extruded. The spinning head 7 may be supplied with a thermoplastic material, for example of the polypropylene type, stored for instance in the form of granules which are melted and then flow under pressure through the multiple orifices situated under the spinning head 7 in order to form filaments 5 by drawing and cooling. The filaments are cooled by forced convection by a conditioning device 8 the shape of which is adapted to that of the spinning head 7 and which generates a laminar air flow at right-angles to the filaments. The rate of flow, temperature and relative humidity of the cooling air are maintained constant. The filaments 5 then pass over a roller 9 which first allows them to be gathered together in the form of a sheet 10 and secondly redirects their path. In this way, it is possible to dispose the spinneret 1 and the spinning head 7 at one and the same level and therefore to produce composite threads on sites where only glass threads were produced hitherto, with no need for major modifications unless it is the installation of a thermoplastic spinning station. Indeed, the means already proposed for the production of composite threads generally require the thread or sheet of glass filaments to arrive above the thermoplastic spinneret, therefore requiring the glass spinneret to be installed at a higher level. This generally leads to a total modification of the structures.

After passing over the roller 9, the sheet 10 of thermoplastic filaments passes over a drum drawing apparatus 11 consisting for instance of six drums 12, 13, 14, 15, 16, 17.

These drums 12, 13, 14, 15, 16, 17 run at different speeds so that they create an acceleration in the direction of travel of the thermoplastic filaments. These drums are likewise associated with the heating and cooling means which are not shown in the drawings. In the case illustrated, the drums may for example function in pairs, drums 12, 13 are then associated with a heating device. This device is for example an electrical system which produces an even and rapid rise in temperature in the thermoplastic filaments because the heating is performed by contact. These drums 12, 13 are driven at a speed, identical for both, which makes is possible to draw out the thermoplastic filaments from the spinning head 7.

The second pair of drums 14, 15 is driven at a speed greater than that of the first pair. The thermoplastic filaments, heated when they pass over the first pair of drums at a speed determined by the nature of the thermoplastic material, undergo an acceleration due to the difference in speeds between the two pairs of drums. This acceleration produces an elongation of the thermoplastic filaments which alters their structure.

The third pair of drums 16, 17 is driven at a speed identical to that of the preceding pair 14, 15 and they comprise a cooling device for example of the "water jacket" type which makes it possible to fix the filaments in their new state.

The heating and cooling of the thermoplastic filaments must be carried out rapidly and evenly. The choice of means employed contributes to this. Furthermore, the invention consists of a processing of filaments and not threads as is usual. The heating and cooling of the filaments may be carried out more rapidly and more homogeneously than if the processing of a thread is involved, due to the fact that the heat exchange surface area is greater per quantity of substance.

The drawing means 11 may likewise consist of more drums, so long as the three previously described zones are respected: heating, drawing, cooling. Furthermore, each of these zones may be composed of a single drum. It is likewise possible for these three zones to be repeated several times, that is to say the thermoplastic filaments, after having undergone the previously described processing, may again be treated one or more times by successive passes through zones of the same type, the process being renewed each time: heating, drawing, cooling.

In order to contribute to the heating and cooling stages, it is likewise possible to incorporate fixed devices for heating or cooling between the rolls of the drawing equipment, over which the thermoplastic filaments slide. Thus, it is possible to prolong the contact time, allowing heat exchanges either for the heating stage or for the cooling stage.

The sheet 10 of thermoplastic filaments then passes over a guide roller 18 which may possibly be motor powered, and a presser roller 19. The thermoplastic filaments are then blended with the glass filaments in such a way that the junction of the two sheets takes place on a surface of the presser roller 19. This mixing apparatus makes it possible to define property the geometry of the sheet of thermoplastic filaments and therefore permits very homogeneous blending.

The assembly of glass and thermoplastic filaments then passes over a device 20 which allows these filaments to be assembled together to form a composite thread 6. This composite thread 6 is then changed to the form of a bobbin 3 by a device not shown which makes it possible to draw the glass filaments at a given linear speed which is maintained constant in order to guarantee the desired mass per unit of length.

This linear speed which makes it possible to draw out the glass filaments must be identical to that imparted by the drums 14, 15 to the sheet of thermoplastic filaments. In this way, all the filaments are at the same speed at the time of mixing and the composite thread displays no undulation when formed.

It is likewise possible to produce a composite thread with a high filling capacity, that is to say which comprises linear glass filaments and undulating thermoplastic filaments. This type of composite thread is in particular interesting for certain weaving applications because it provides bulk for the woven fabric.

To produce such a composite thread, it is preferable to modify the device shown in FIG. 1 and more particularly the system permitting mixing of the thermoplastic filaments with the glass filaments.

Figure 2:
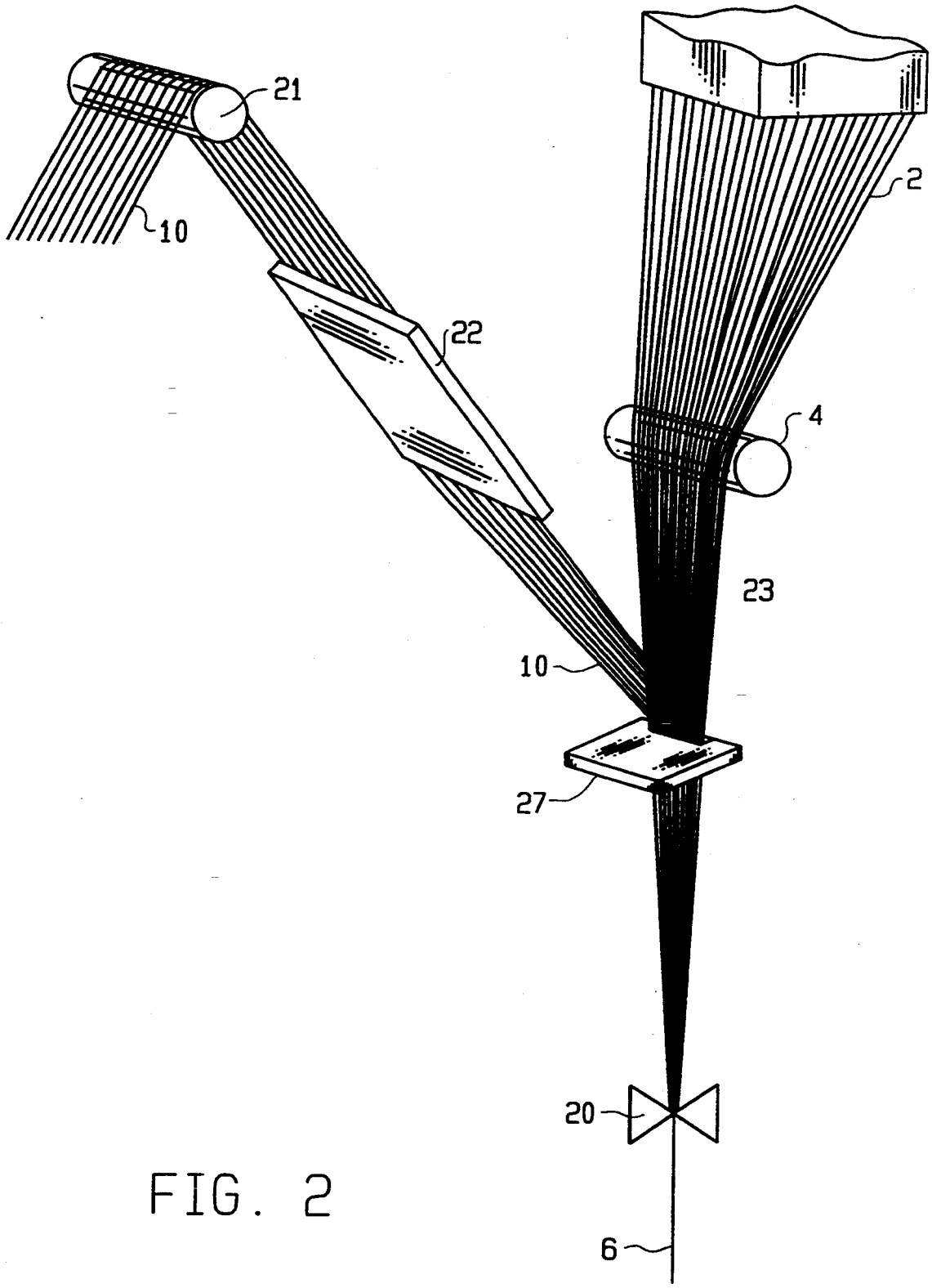
FIG. 2 is a diagrammatic representation of a second embodiment.

This other device is shown in FIG. 2. This drawing only shows the apparatus for blending the two types of filament. The rest of the apparatus remains identical to FIG. 1. One essential difference which is not shown is that the speed imparted to the sheet of thermoplastic filaments by the drawing equipment 11 and more particularly by the drums 14, 15 is no longer identical to the speed at which the glass filaments are drawn out. Indeed, in order to obtain undulating thermoplastic filaments in the composite thread, their speed must be greater than the drafting speed of the glass filaments at the time of mixing.

This FIG. 2 shows the sheet 10 of thermoplastic filaments after they have passed over the drawing apparatus 11 which is not shown. The sheet 10 which has therefore already undergone treatment over the drawing apparatus and which is at the desired speed passes over a diverting roller 21 then through a venturi system 22. This apparatus projects the sheet 10 of thermoplastic filaments into the sheet 23 of glass filaments, maintaining the thermoplastic filaments individualized. On the other hand, the venturi device does not impart any additional speed to the sheet 10 so that a minimum of compressed air is projected onto the glass filaments. In this way, the risks of disturbance in the glass filaments due to the emission of compressed air in addition to the protection of thermoplastic filaments are minimized.

An element 27 may likewise be added to this apparatus. This is a plate comprising a recess of a size which allows passage of the sheet of glass filaments. This element 27 makes it possible in particular to retain the geometry in the form of a sheet 10 of thermoplastic filaments after projection and avoids the divergence of the thermoplastic filaments.

This element 27 is preferably made from a composite material of textile fabric and phenolic resin of the bakelite type, permitting sliding of the filaments.

In FIG. 2, the thermoplastic filaments are projected into a sheet of glass filaments after passing over the sizing roller 4. It is likewise possible to project the thermoplastic filaments into the bundle 2 of glass filaments, that is to say before these pass over the sizing roller 4. The homogeneity of the mixture of filaments obtained may be greater in this latter case.

As the thermoplastic filaments are projected into the sheet or bundle of glass filaments, the two types of filament blend to form a composite thread on a device 20 identical to that in FIG. 1.

These techniques therefore result in the formation of bobbins of composite threads which, in contrast to those obtained hitherto, do not display any undulation due to the glass filaments and which can be unwound without problem. It is likewise possible, since the bobbins do not undergo any deformation, to remove the sleeve which can then be used again and to unwind the bobbins from the inside. Furthermore, the glass filaments remain linear and can fully play their part as unidirectional reinforcement, when desired, in articles produced from these composite threads.

Figure 3A:
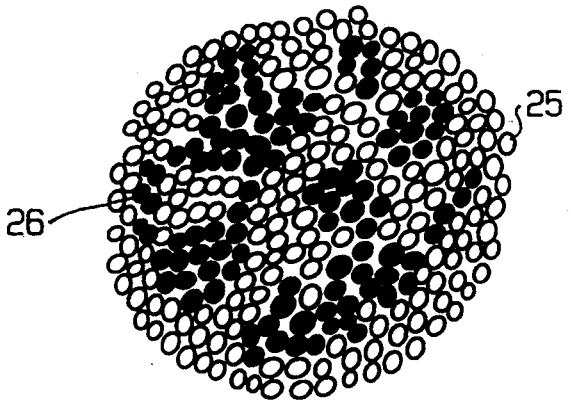
FIGS. 3 *a, b, c* are diagrammatic representations of cross-sections through composite threads obtained according to the invention and according to the prior art techniques.
Figure 3B:
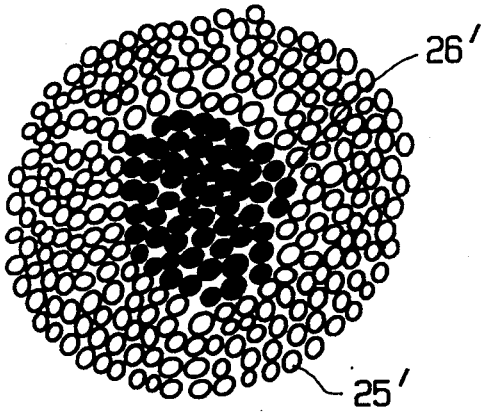
FIG. 3b Prior Art
Figure 3C:
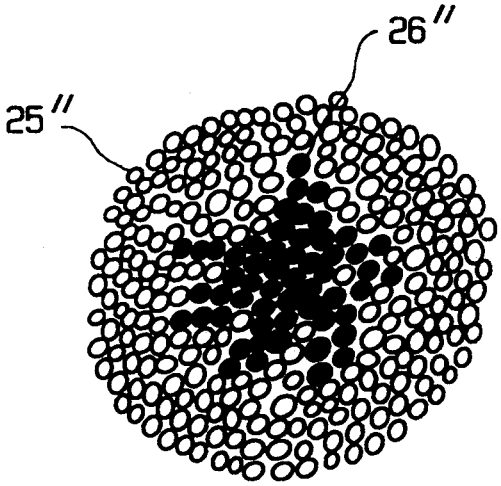
FIG. 3c Prior Art

Diagrammatically shown in FIGS. 3*a, b, c* are cross-sections through composite threads obtained by different processes. FIG. 3*a* shows a cross-section through a composite thread obtained according to the invention. The drawing shows a homogeneous distribution of thermoplastic filaments 25 and glass filaments 26. Proper homogenization of the composite thread results in better cohesion in the composite thread. FIGS. 3*b* and 3*c* shown cross-sections through composite threads obtained by other processes such as the use of an annular thermoplastic spinneret or by thread-to-sheet association (FIG. 3*b*) or sheet-to-sheet association (FIG. 3*c*). In both cases, the filament distribution is less homogeneous and the core of the thread is a zone preferred by glass filaments 26', 26'' while the thermoplastic filaments 25', 25'' are more on the periphery. It can be noted that the sheet-to-sheet assembly produces better homogenization.

It is possible to make a few modifications to the apparatus described. First of all, the sizing solution may contain a photo-initiator adapted to commence a chemical transformation of the sizing solution under the effect of actinic radiation. Such sizing makes it possible further to enhance the cohesion of the composite thread. In order to use it, it is sufficient to dispose in the path of the composite thread a radiation source of the ultraviolet type, between the assembly apparatus and that which makes it possible to produce a bobbin. It may likewise be a thermal initiator which is used for a thermal treatment.

It is likewise possible to associate the invention with the production of complex composite threads, that is to say composite threads comprising different thermoplastic organic substances. For this, it is possible to project filaments of different types obtained for instance from several spinning heads and preassembled prior to projection onto the glass filaments.

We claim:

1. In a method of producing a composite thread formed by the blending of continuous glass filaments emanating from a spinneret and continuous thermoplastic filaments of thermoplastic organic matter emanating from at least one spinning head, the improvement comprising the steps of:

a) forming said thermoplastic filaments in the form of a sheet;

b) heating said thermoplastic filaments;

c) stretching said thermoplastic filaments to a stretched state when heated;

d) cooling said thermoplastic filaments in their stretched state;

e) forming said glass filaments into a cluster of sheet; and f) blending the cooled thermoplastic filaments into said cluster or sheet of glass filaments.

2. The method according to claim 1, wherein said blending of said thermoplastic filaments and the glass filaments occurs at identical speeds over the outer surface of a roller.

3. The method according to claim 1, wherein said blending comprises projecting said sheet of said thermoplastic filaments onto said cluster or sheet of glass filaments.

4. The method according to any one of claims 1–3 wherein said thermoplastic filaments are accelerated in their speed of movement away from said spinning head during the heating to effect stretching thereof.

5. In an apparatus for producing a composite thread formed by the blending of continuous glass filaments and continuous thermoplastic filaments of thermoplastic organic matter said apparatus including at least one spinneret and of which the underside is provided with a multiplicity of orifices through which glass filaments are drawn, a coating device for coating said glass filaments, at least one spinning head, the underside of which is provided with a plurality of orifices through which thermoplastic filaments are delivered, blending means for blending the thermoplastic filaments with the glass filaments to produce a composite thread, and means common to the spinneret and the spinning head for allowing assembling and drawing of the composite thread, the improvement comprising:

a) at least one drawing means disposed between said spinning head and said blending means, said drawing means including:

1) means for heating said thermoplastic filaments;

2) means for stretching said thermoplastic filaments when heated to a stretched state after being heated by said heating means;

3) means for cooling said thermoplastic filaments in said stretched state; and 4) at least one drum over which said thermoplastic filaments are drawn for directing said cooled thermoplastic filaments away from said spinning head and toward said blending means.

6. The apparatus according to claim 5, wherein said drawing means has at least a first group, second group, and third group of drums disposed one after the other, as measured in a direction extending away from said spinning head, for ensuring an increasing speed of the thermoplastic filaments as they are drawn away from said spinning head.

7. The apparatus according to claim 6, wherein the first group of drums comprises the heating means, the second and third groups of drums comprise the stretching means and are driven at a speed higher than the first group of drums to accelerate the speed of movement of the thermoplastic filaments after being heated by said first group of drums.

8. The apparatus according to claim 6, wherein the heating means are electrical and are situated at least in a drum disposed nearest the spinning head.

9. The apparatus according to claim 6, wherein said heating means heat by infrared radiation and are placed in the path of the thermoplastic filaments, at least at the location of a drum disposed nearest the spinning head.

10. The apparatus according to claim 6, wherein said cooling means includes means for circulating cold fluid at least in a drum disposed furthest the spinning head.

11. The apparatus according to any one of claims 5 to 7, wherein the blending means for blending thermoplastic filaments with the glass filaments comprises a guide roller and a presser roller for blending the filaments while moving at equal speeds.

12. An apparatus according to any one of claims 5 to 7, wherein the blending means for blending the thermoplastic filaments with the glass filaments is a venturi device for blending the filaments while the thermoplastic filaments are moving at a speed higher than glass filaments.

* * * * *